US006407377B1

(12) United States Patent
Mettler

(10) Patent No.: US 6,407,377 B1
(45) Date of Patent: Jun. 18, 2002

(54) APPARATUS FOR READING-OUT A SETTING OF NUMBER WHEELS

(75) Inventor: Roland Mettler, Neuhausen am Rheinfall (CH)

(73) Assignee: MR Engineering AG, Neuhausen am Rheinfall (CH)

( * ) Notice: Subject to any disclaimer, the term of this patent is extended or adjusted under 35 U.S.C. 154(b) by 0 days.

(21) Appl. No.: 09/260,525

(22) Filed: Feb. 26, 1999

(30) Foreign Application Priority Data

Feb. 27, 1998 (EP) ..... 98810161

(51) Int. Cl.[7] ..... G06M 1/272
(52) U.S. Cl. ..... 250/231.13; 250/231.14
(58) Field of Search ..... 250/231.13, 231.14, 250/231.15, 231.17, 231.18, 230; 340/870.02, 870.03; 235/95 R, 96, 110, 117 R, 117

(56) References Cited

U.S. PATENT DOCUMENTS

| | | | |
|---|---|---|---|
| 3,732,404 A | 5/1973 | Jones | |
| 4,031,386 A | 6/1977 | Recker | 250/231.18 |
| 5,146,066 A | 9/1992 | Brun et al. | |
| 5,543,613 A * | 8/1996 | Mettler | 250/231.15 |
| 5,565,861 A | 10/1996 | Mettler et al. | |

FOREIGN PATENT DOCUMENTS

| | | |
|---|---|---|
| EP | 325 565 | 7/1989 |
| EP | 344 931 | 12/1989 |
| EP | 435 763 | 7/1991 |
| GB | 1 410 912 | 10/1975 |

* cited by examiner

*Primary Examiner*—F. L. Evans
(74) *Attorney, Agent, or Firm*—Cohen, Pontani, Lieberman & Pavane

(57) ABSTRACT

Equipment for reading-out the setting of number wheels of a number barrel mechanism with switching pinions on an axle within the circumference of number wheels. Via the switching pinions the respective lower value number wheel in the last scale part of its revolution rotates the higher value number wheel forward by one scale part. With a respective opti-electronic element within the number wheels and peripheral optical elements, several radial light barriers are formed for each number wheel. The number wheels have translucent code segments and opaque code segments. During sequential reading-out, binary information data are formed in Gray code and the read-out data are processed further in a microprocessor.

9 Claims, 5 Drawing Sheets

APPARATUS FOR READING-OUT A SETTING OF NUMBER WHEELS

BACKGROUND OF THE INVENTION

1. Field of the Invention

The present invention relates to an apparatus for reading-out the setting of number wheels of a number barrel mechanism with switching pinions on an axle within the circumference of the number wheels. By way of the pinions, the respective lower value number wheel at the end of a complete revolution rotates the higher value number wheel further through one numeral or one scale part.

2. Discussion of the Prior Art

Different kinds of measuring instruments are known in which the measured magnitude is added up and indicated by a mechanical number barrel mechanism. Examples of this are volume-measuring instruments for gas and water or mechanical electricity meters, in which the measured volume or the measured energy is transmitted by a mechanical step-down gear, which is matched to the instrument, to a number barrel mechanism. The number barrel mechanism in that case indicates the quantity measured since the last zero setting or since first being put into commission. For determining the consumption during a certain period, the state of the number barrel mechanism is read off at the beginning and at the end of this period. A common construction for the number barrel mechanism consists of an axle, on which the number wheels are mounted to be rotatable and on the circumference of which the numerals 0 to 9 are applied, as well as of a second axle, which lies externally of the number wheels, with switching pinions rotatable thereon in such a manner that the respective lower value number wheel in the last tenth of a revolution steps the next higher value wheel forward by one tenth of a revolution. In a different construction of the number barrel mechanism the switching pinions are mounted on an axle within the circumference of the number wheels. Such a number barrel mechanism is known, for example from U.S. Pat. No. 4,031,386.

This classic type of number barrel mechanisms is very useful for many purposes and continues to be usable. In case of need, the counter settings must, however, be read off by a person and intermediate totals, for example for statistics and provision of accounts, must be computed.

From U.S. Pat. No. 3,732,404, a solution is known for the electronic reading-out of a number barrel mechanism, in which the continuous rotational movement of the number wheels is translated into a snapping movement. From European reference EP 0 660 263 A1, a solution is known for the electronic reading-out of a number barrel mechanism with switching pinions lying externally of the number wheels, which mechanism comprises five axially arranged one-way light barriers for each number wheel.

SUMMARY OF THE INVENTION

The present invention is based on the object of providing a reading-out equipment for a number barrel mechanism with switching pinions mounted on an axle within the number wheels. The equipment, via simple means, yields a high resolution on the scanning of a number wheel setting and operates independently of the drive of the number barrel mechanism and does not influence the drive in any manner.

The reading-out equipment according to the invention is distinguished in that the state of the display of a mechanical number barrel mechanism with inwardly disposed switching pinions is read out contactlessly and load-free by means of radially arranged light barriers.

Several light barriers, which consist of one light source and several receivers or of several light sources and one receiver, are present for each number wheel.

The number wheels comprise light-permeable and light-impermeable code segments, by means of which together with the light barriers, information can be ascertained concerning the setting of the individual number wheels.

The light barriers are arranged radially on a semicircle and, for each number wheel, consist of an internal centrally arranged opti-electronic element and several elements arranged peripherally in a semicircle.

For the purposes of focussing and association of the light beams with the corresponding receiver or with the corresponding receivers, the internal centrally arranged optical element can, for example, be surrounded by a star-shaped multiple prism.

The peripheral elements are formed as glass-like optical conductors and serve as optical signal conductors between the number barrel mechanism and, by way of further opti-electronic elements, the signal inputs of a microprocessor.

During one complete revolution of each number wheel, more than 10 different states are produced in the form of a multiplace digital information. In one exemplary embodiment, 30 states with a five-place digital information are produced.

For the avoidance of undefined intermediate settings during the transition from one reading-out position to a next reading-out position, the Gray code is applied. In the case of the Gray code, only a single bit of a binary information is varied during the transition from one position to the next.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
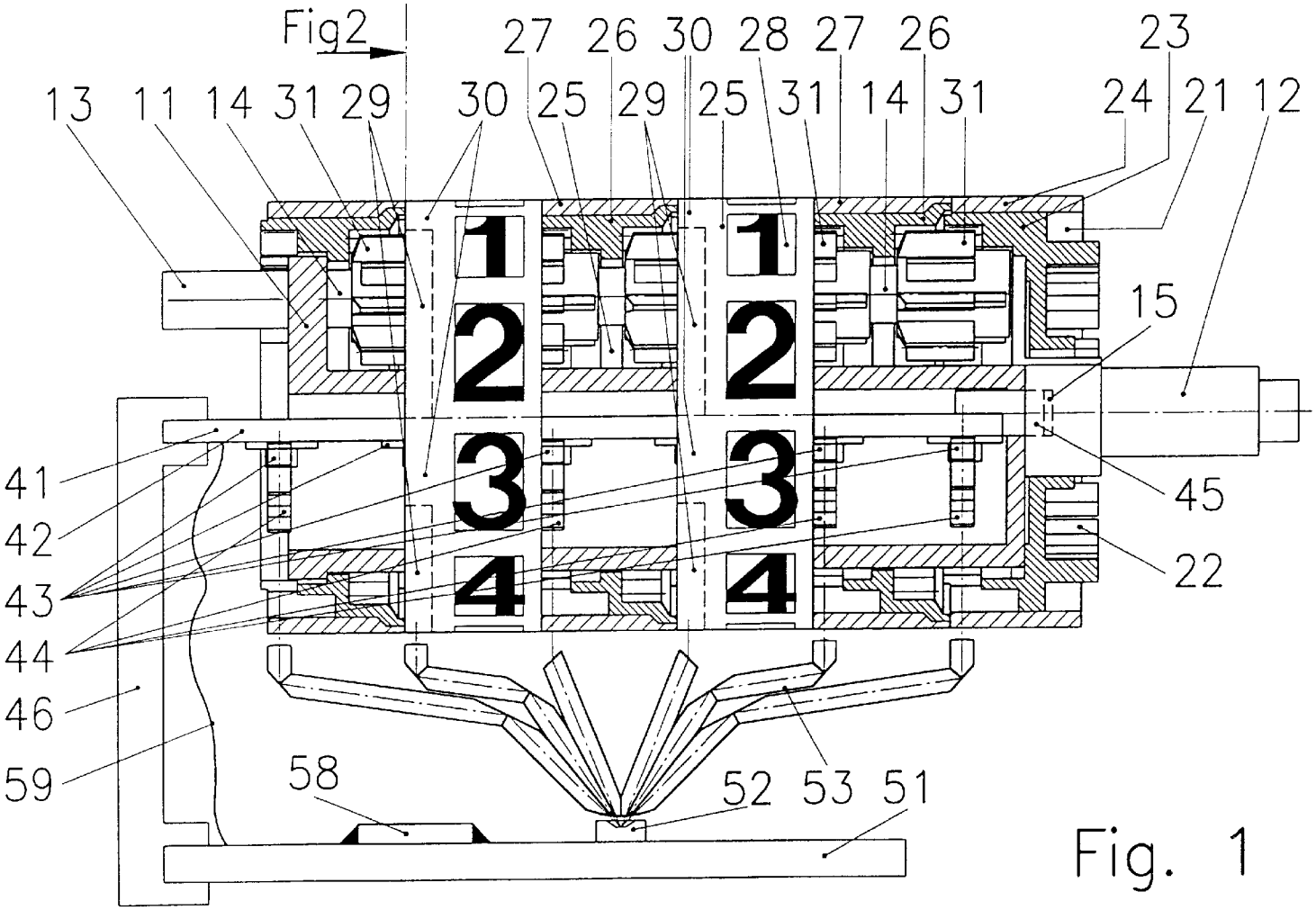
FIG. 1 is a partially sectioned view of one embodiment of the present invention.

The FIG. 1 shows a carrier drum 11, on which—seen from right to left—a first number wheel 21 and a further five number wheels 25 are mounted so as to be rotatable. Of the six number wheels 21 and 25, the first number wheel 21, the second, fourth and sixth number wheels 25 are shown in section and the third and fifth number wheels 25 are shown in external view. Numerals 28 from 0 to 9 are applied at the circumferential surface on an outer transparent body 24 or 27 of the number wheels 21 and 25. The first number wheel 21 comprises an internal, non-transparent body 23 and the further number wheels 25 each comprise a respective internal, non-transparent body 26. Translucent or opaque code segments are indicated respectively by 29 and 30. The internal toothing of the first number wheel 21 is denoted by 22. The carrier drum 11 is fastened by a right-hand fastening axle 12 and by a left-hand fastening axle 13 in a not-illustrated counting mechanism housing. Disposed at the carrier drum 11 is a switching pinion axle 14, on which switching pinions 31 are mounted to be rotatable, which rotate a higher value number wheel 25 onward each time by one tenth of a revolution in the last tenth of the revolution of the lower value number wheels 21 and 25. In the carrier drum 11 is an internal optical element unit 41, which on one side is retained by a guide spigot 45 in a guide bore 15 in the carrier drum 11 and on the other side is fastened at a print holder 46.

Figure 2:
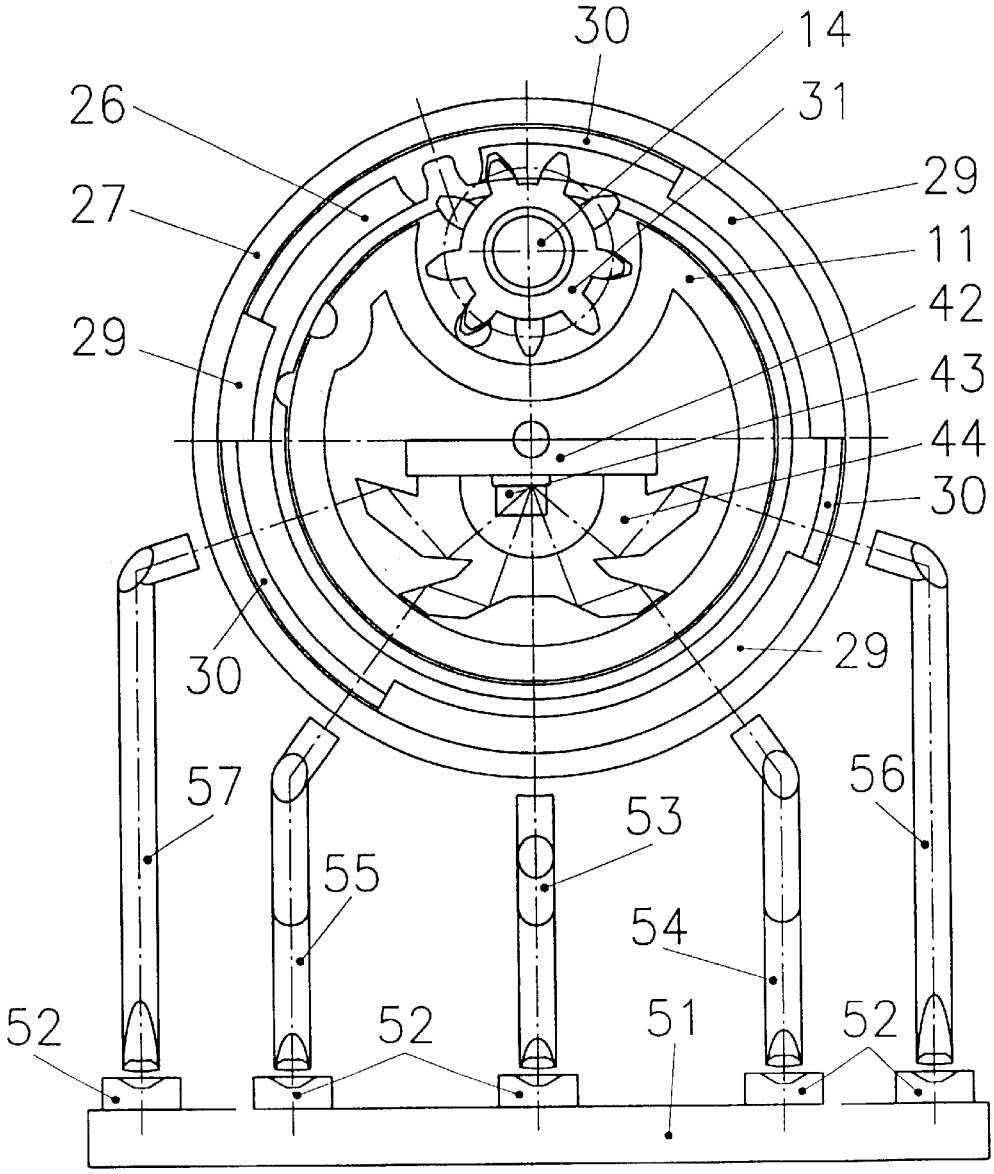
FIG. 2 is a lateral section through the embodiment of FIG. 1.

The internal optical element unit 41 is explained more closely in FIG. 2. The internal optical element unit 41 furthermore comprises a printed circuit 42, on which a semiconductor optical element 43 and an optical multiple prism 44 are mounted for each number wheel at the spacing between the number wheels 21 and 25.

Externally of the carrier drum 11 and the number wheels 21 and 25 is an external printed circuit 51, which comprises five semiconductor optical elements 52 arranged one behind the other, five optical conductors 53 to 57 and a microprocessor 58. This circuit is connected by way of electrical connections 59, for example wires, with the internal optical element unit 41. The semiconductor optical elements 52 can be constructed as light receivers and the internal optical element units 41 can each be constructed as a light emitter (light-emitting diode) by means of a semiconductor optical element 43. A converse association of the functions of light-emitting and light-receiving is likewise possible.

FIG. 2 shows a view into the interior of a number wheel 25 in the axial direction with the associated external elements and further details not completely visible in FIG. 1. It is to be assumed here that the printed circuit 42 comprises a semiconductor optical element 43 in the form of a light-emitting diode which serves as a light emitter and which is activated briefly during the reading-out of the number wheels 21 and 25. The semiconductor optical element 43 is arranged in the center of the optical multiple prism 44. The star-shaped multiple prism 44 has a toothed external outline with, for example, four teeth as prism with internal double reflection. The task of this multiple prism 44 consists in dividing and focussing the light of the semiconductor optical element 43 into individual light beams. Furthermore, as indicated in FIG. 1, each number wheel 21 and 25 comprises three translucent code segments 29 and three opaque code segments 30, here shown to be visible, at the circumference in the radial plane of the multiple prism 44. The translucency of a code segment 29 is advantageously restricted to light of defined wavelengths. Such light can be light invisible to the eye, for example infrared light. Focussed light beams in the region of the translucent code segments 29 impinge during the reading-out process on the optical conductors 53 to 57 arranged in pitch corresponding with the multiple prism 44. In the shown setting of the number wheel 21 or 25, the light beams for the optical conductors 57, 55 and 56 are interrupted by opaque code segments 30 and are visible for the optical conductors 53 and 54 through the translucent code segment 29. The visible light beams are conducted by way of the optical conductors 53 and 54 by way of internal reflection at the bent-over place to the associated optical semiconductor element 52 constructed as a light receiver. At the instant of the reading-out of this number wheel 21 or 25, a five-place binary number is formed by way of an evaluation described later. If a light passage is defined as logic "1" and a light barrier is defined as logic "0", the five-place binary number 00110 arises here in the instant of reading-out.

Figure 3:
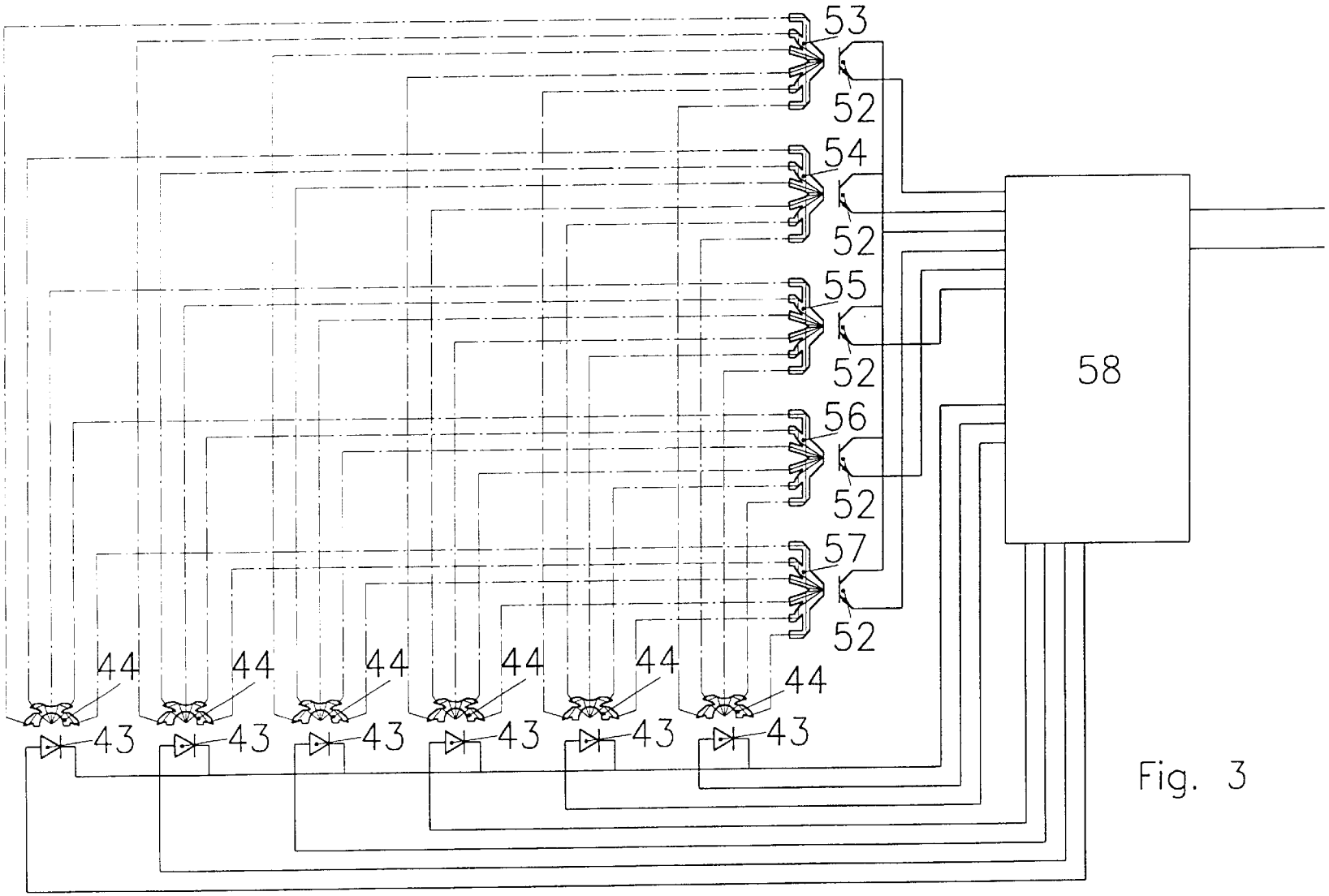
FIG. 3 shows a basic circuit diagram of the opti-electronic elements and of the microprocessor.

FIG. 3 shows the basic circuit diagram of the opti-electronic elements (light emitters 43 and light receivers 52) with the microprocessor 58 as well as the light-conducting elements of the multiple prism 44 and the optical conductors 53 to 57. The paths of light or data are illustrated by the chain-dotted lines. Each individual path of light or data can be denoted as a one-way light barrier in the embodiment according to the invention. The equipment illustrated in the present example correspondingly comprises thirty one-way light barriers in the case of six number wheels 21 and 25 and five optical scanning points for each number wheel 21 and 25. The five reading-off points for each number wheel 21 or 25 are arranged at a regular pitch within a semicircle. The pitch angle amounts to 36° in the shown example, but can also have other values, for example a multiple of 36°. Equally, the pitch could also be irregular.

If the light emitters 43 associated with the individual number wheels 21 and 25 are activated in sequence, the read-out binary data for each number wheel 21 or 25 are present at the same rate at the microprocessor 58 by way of the light receivers 52. The influence of the translucent code segments 29 and the opaque code segments 30 of the individual number wheels 21 and 25 is not illustrated in this basic diagram.

Figure 4:
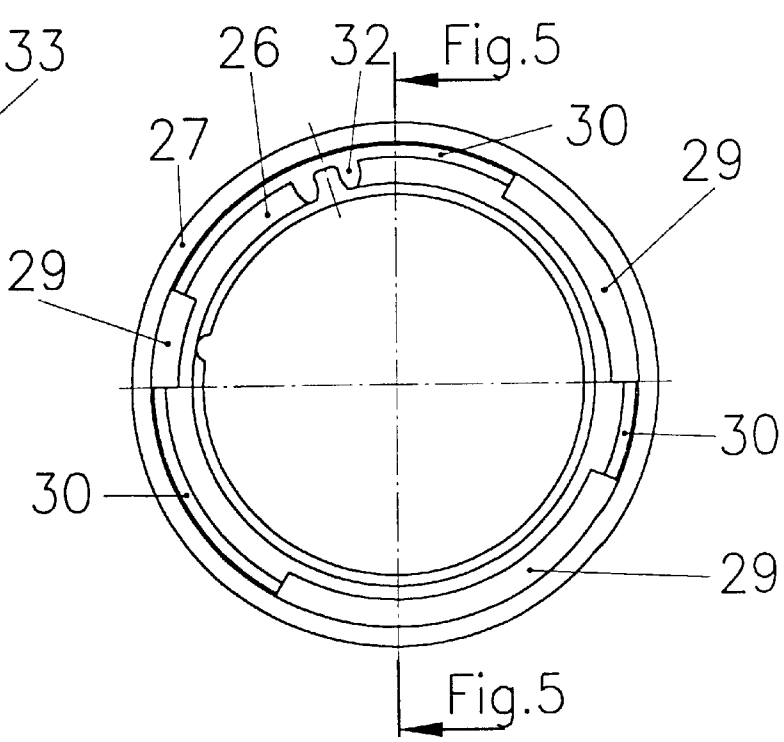
FIG. 4 is a front view of a number wheel.
Figure 5:
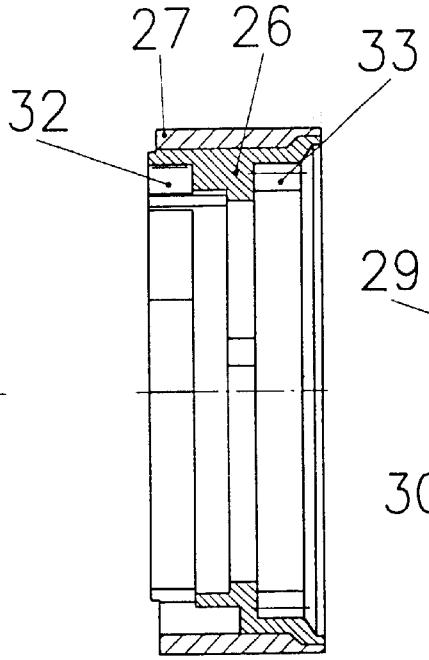
FIG. 5 is a cross-section through a number wheel.
Figure 6:
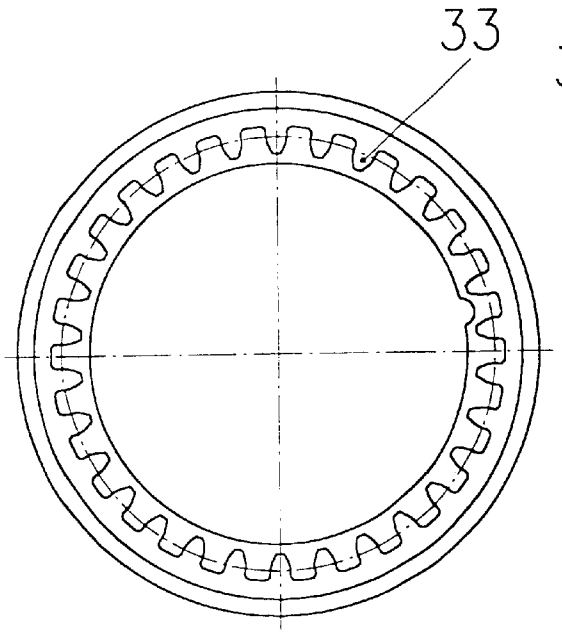
FIG. 6 is a rear view of a number wheel.

FIGS. 4 to 6 show details of a number wheel 25. In the view of the FIG. 4, two stepping teeth 32 are visible, which for each revolution of this number wheel 25 move the next higher number wheel 25 forward by one numeral position by way of the switching pinion 31. For this purpose, each number wheel 25 has an uninterrupted internal toothing 33 on the other side, according to FIG. 6. According to the sectional illustration in FIG. 5, the stepping teeth 32 are disposed on the left-hand side in the interior of the non-transparent body 26 of the number wheels 25 and the internal toothing 33 is disposed on the right-hand side of the number wheels 25. The first number wheel 21, which is not illustrated in these FIGS. 4 to 6, by contrast to the number wheels 25 comprises an internal toothing 22, into which a not-illustrated drive of the counting mechanism engages, on the right-hand side. The number wheel 21 likewise comprises not directly visible stepping teeth 32 at the left.

Figure 7:
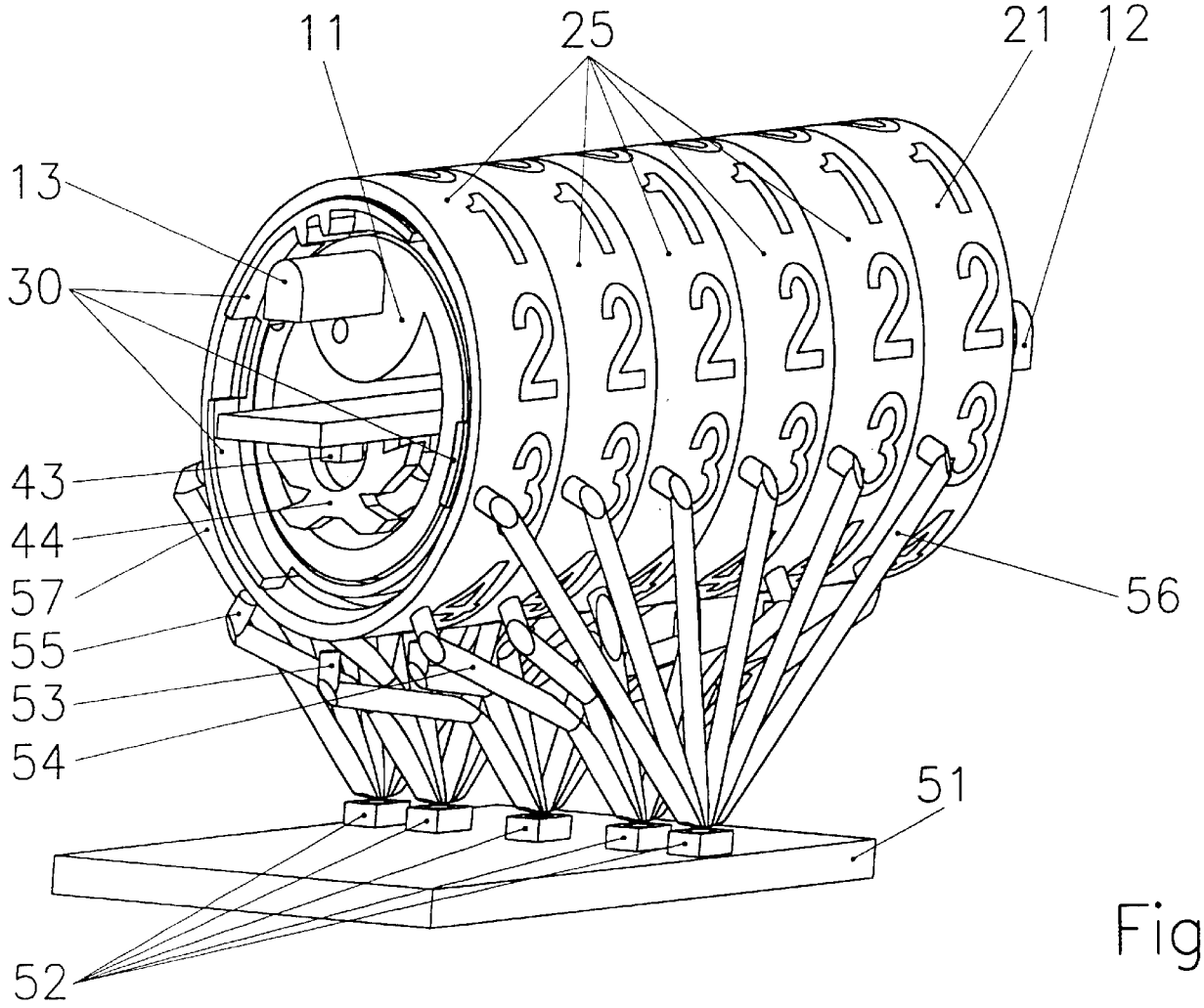
FIG. 7 is a perspective view of the invention.

FIG. 7 shows a perspective view of the reading-out equipment according to the invention for a number barrel mechanism. It is evident here that each of the five optical scanning positions of each individual number wheel 21 and 25 leads by way of the optical conductors 53 to 57 to one light receiver 52 associated with each scanning position.

In the following, the function of the reading-out equipment according to the invention is explained more closely by the example of a reading-out operation. For this functional description, the construction with a respective central light source in each number wheel 21 and 25, which is shown in the drawings, forms the basis. The reading-out operation is started upon calling-up by a programmed command of the microprocessor 58. The reading-out operation runs sequentially in that the light emitter 43 is activated briefly, for example beginning with the number wheel 21, in each following number wheel 25 in sequence step after step. Its light will then be projected radially through the multiple prism 44 onto the five positions of the peripheral elements, thus onto the optical conductors 53 to 57, but reaches these only in those positions, where a translucent code segment 29 is disposed in the radial light beam. Transmitted light is conducted by way of one or more of the optical conductors 53 to 57 onto one or more of the optical receivers 52. The receiver 52 in the case of light reception produces a logic "1" at the corresponding input of the microprocessor 58. After a reading-out sequence, the setting of each individual number wheel 21 and 25 is imaged in Gray code by a five-place binary information. The reading-out resolution for each number wheel 21 and 25 is not restricted only to the shown decimal division. With the equipment according to the invention, thirty different settings can be defined logically at the circumference of a number wheel 21 or 25. With corresponding expenditure with respect to the number of light barriers and code segments 29 and 30, a still greater reading-out resolution can be achieved, if required. The five light barriers, which are shown by way of example, for each number wheel 21 and 25 result in thirty different codes as binary number during a full revolution through 360°.

In a further embodiment of the present invention, an optical receiver 43 (phototransistor), above which the multiple prism 44 is situated, is mounted within the number wheels 21 and 25 for each number wheel 21 and 25, wherein the multiple prism 44 conducts the light, which is incident radially in five defined directions through the number wheels 21 and 25, onto the optical receiver 43 and wherein the five defined radial directions of incidence include an angle of 36° between each two directions. Furthermore, six successive segments are mounted at angles of for example 96°, 24°, 60°, 96°, 24° and 60° on each number wheel 21 and 25 on a part on a part of the width of the entire number wheel, of which segments each time in alternation one code segment 30 is opaque to the light of the wavelength used by the receiver 43 and by the emitter 52 and the next following code segment 29 is translucent for the light of the wavelength used and five light-emitting elements are mounted externally of the number wheels. From these elements the optical conductors 53 to 57 steer the light for each emitting element into one of the five directions defined by the light conductors 53 to 57 on the receivers 43 onto the region of each number wheel 21 and 25, where the six afore-described segments 29 and 30 are disposed. The number wheels 21 and 25 are in that case advantageously structured so that the numerals 28 of 0 to 9 are applied externally on the right-hand side, where the internal toothing 33 for the drive of the number wheels 21 and 25 by the switching pinion 31 is situated within the number wheels 21 and 25, and that the six translucent code segments 29 or opaque code segments 30 are situated on the left-hand side beside the numerals 29 with an opaque segment in the region, where the two teeth 32 for the stepping-forward of the switching pinion 31 after a complete revolution of the number wheel 21 and 25 are situated. The other advantageous embodiment, which is illustrated in the drawings, of the invention has, as is evident from the descriptions of the figures, one light-emitting element 43 for each number wheel within the number wheels and, externally of the number wheels 21 and 25, altogether five optical receivers 52 on the peripheral printed circuit 51.

The number wheels 21 and 25 can be formed as an injection-molded synthetic material part produced in two operating steps, in which the inner part is produced of a material (for example of synthetic material colored black) opaque to the light used, where the inner part comprises the toothings 32 and 33 and the guide for centering on the carrier drum 11, and which is subdivided into three segments on the left-hand side, which segments together with their intermediate spaces form the six afore-described code segments 29 and 30, and of a material, which is transparent to the light used and from which an outer ring is injection-molded, for example of white unfilled synthetic material in the case of the use of infrared light elements. The numerals 28 on the number wheels 21 and 25 can be applied on the external circumference by printing-on or hot-embossing, for which care is to be taken that the numerals 28 do not cover over the code segments 29 and 30.

An advantageous variant of structure for the optical elements 41 mounted within the number wheels 21 and 25 comprises the printed circuit 42, on which the respective optical semiconductor element 43 is applied in surface mounting for each number wheel 21 and 25, with a respective optical conductor element in the form of the multiple prism 44, which through deflection reduces the entire optical angular range from four times 36°=144° to a smaller angular range.

The optical conductor elements 53 to 57 can in known manner be structured as transparent elements with total reflection surfaces or with external mirror reflection surfaces.

An advantageous embodiment for the optical elements disposed externally of the number wheels 21 and 25 comprises a printed circuit 51, from which—apart from five optical elements 52 for the production of the five signals per number wheel 21 and 25—also a microprocessor 58 with the necessary accessory elements for the control and the evaluation of the opti-electronic elements and the connections for a data transmission interface are mounted. Five optical conductors 35 to 57 of synthetic material with a number of optical conductor arms corresponding with the number of number wheels receive the light from all the number wheels 21 and 25 on an optical element 43 in the case of the embodiment where the external optical elements 52 are receivers, for example phototransistors, or distribute the light over all six number wheels 21 and 25, where the external optical elements are emitters, for example luminescent diodes. The five optical elements 52 on the external printed circuit 51 and the five optical conductors 53 to 57 of synthetic material are constructed so that the light, which is either received or emitted by them, is directed onto the rotational axis of the number wheels 21 and 25 each time in the region of the code segments 29 and 30 and the five directions include angles of 36° between them. It is advantageous for the screening of external light to provide the external optical elements 52 and the external optical conductors 53 to 57 with an additional non-transparent envelope.

As mentioned in the preceding in the description of the figures, the semiconductor optical elements 43 and 52 together with the optical conductors 44 and 53 to 57 for each number wheel 21 and 25 each form five one-way light barriers which are interrogated sequentially by the microprocessor 58 for the reading-out of the value indicated by the number barrel mechanism.

The five one-way light barriers result, in the case of a complete revolution of a number wheel 21 and 25 through 360°, in the following thirty codes as binary number:

| Angle of rotation | Indicated numeral | Code (as binary number) |
|---|---|---|
| 0° | 0 | 00110 |
| 12° | 0 | 00111 |
| 24° | 0 | 10111 |

-continued

| Angle of rotation | Indicated numeral | Code (as binary number) |
|---|---|---|
| 36° | 1 | 10011 |
| 48° | 1 | 00011 |
| 60° | 1 | 01011 |
| 72° | 2 | 01001 |
| 84° | 2 | 00001 |
| 96° | 2 | 00101 |
| 108° | 3 | 00100 |
| 120° | 3 | 00000 |
| 132° | 3 | 00010 |
| 144° | 4 | 10010 |
| 156° | 4 | 10000 |
| 168° | 4 | 10001 |
| 180° | 5 | 11001 |
| 192° | 5 | 11000 |
| 204° | 5 | 01000 |
| 216° | 6 | 01100 |
| 228° | 6 | 11100 |
| 240° | 6 | 10100 |
| 252° | 7 | 10110 |
| 264° | 7 | 11110 |
| 276° | 7 | 11010 |
| 288° | 8 | 11011 |
| 300° | 8 | 11111 |
| 312° | 8 | 11101 |
| 324° | 9 | 01101 |
| 336° | 9 | 01111 |
| 348° | 9 | 01110 |
| 360°/0° | 0 | 00110 |

It is evident from this table that the reading-out of a number wheel 21 and 25 takes place with an angular resolution of 12° of angle. This means that up to thirty settings per number wheel 21 and 25 can be read out with this resolution, which also means that the application of the reading-out equipment according to the invention is not restricted only to decimal counting systems. The settings, which are ascertained in binary code, of the number wheels 21 and 25 are converted in sequence further into readable numerical information internally of the processor in known manner and processed further according to requirement for protocols, statistics, accounts and so forth.

The optical conductor elements 53 to 57 can in known maimer be structured as transparent elements with total reflection surfaces or with external mirror reflection surfaces. Preferably, a suitable synthetic material is used.

For the variant where the external optical elements are light emitters, thus light sources, the reading-out takes place in principle like as described in the preceding. The five light sources are activated in sequence for each number wheel 21 and 25 and the setting of each number wheel 21 and 25 is thus read out as a binary number.

It is advantageous for the screening of external light to provide peripheral optical elements which are exposed to daylight and/or external light, such as for example the optical conductors 53 to 57, with an additional, non-transparent coating or envelope.

The geometric division of the code segments 29 and 30 in the case of the number wheels 21 and 25 is so disposed that all light barriers can be checked for their function in simple and rapid manner. For this checking, merely the entire wheel packet with the carrier drum is rotated forward from the initial setting (all numerals indicating "0") through 36° (all numerals indicating "1") and back through, 36° (all numerals indicating "9"). For the chosen geometry of the code segments 29 and 30, all signals of all light barriers each assume both states during this check and thus all light barriers can be tested. In addition, an individual scaling factor can be measured for each light barrier and filed by the processor 58 in a captive storage device (EPROM).

In a further preferred geometric division, the code segments 29 and 30 for the number wheels 21 and 25 are so disposed that all light barriers have light permeability for the counting mechanism setting "000000" so that the amplification of the light barriers can be measured.

Used as the microprocessor 58 is preferably a processor which can controllingly drive the light-emitting optical elements 43 or 52 directly with an adequate current, for example five milli-amps per element, and which comprises an analog-to-digital converter with several inputs which are switchable over and by which the microprocessor can measure the resistance of the light receivers 52 and thereby the luminous intensity. In a preferred embodiment of the present invention, the microprocessor additionally measures the current in each of the light-emitting elements when it switches these on. Thereby, a defect of an element can be recognized and the functional reliability thus be improved. In a further preferred embodiment, the outer optical conductors 53 to 57 have one arm more than the number of the number wheels of the counting mechanism and the inner optical element unit 43 comprises one element more than the number of the number wheels 21 and 25 of the counting mechanism. Thereby, the microprocessor 58 can check the function of the outer optical elements and thus additionally improve the functional reliability. For the purpose of screening and avoidance of function-disturbing stray light, not-illustrated additional light screens can be mounted between the inner neighbouring optical elements 41.

The invention is not limited by the embodiments described above which are presented as examples only but can be modified in various ways within the scope of protection defined by the appended patent claims.

What is claimed is:

1. A combination, comprising:

a number barrel mechanism having number wheels, and switching pinions on an axle, the number wheels being operatively arranged so that a respective lower value number wheel at an end of a complete revolution rotates an adjacent higher value number wheel further through one numeral part; and an apparatus comprising radially arranged light barrier means for a contactlessly and load-free reading-out of a setting of the number wheels, the light barrier means including several light barriers comprised of one light emitter with several receivers provided for each number wheel.

2. The combination according to claim 1, wherein the number wheels comprise at least one light-permeable code segment and at least one light-impermeable code segment to facilitate ascertaining of the setting by the light barrier means.

3. The combination according to claim 2, wherein the code segments are arranged to extend over angles of different sizes.

4. The combination according to claim 2, wherein an angularly geometric arrangement of the light-permeable code segments and the light-impermeable code segments is present on each number wheel so as to permit a reading-out of more than ten different settings during one complete revolution of a number wheel.

5. The combination according to claim 2, wherein light barriers and the code segments are arranged to produce a Gray code.

6. A combination, comprising:

a number barrel mechanism having number wheels, and switching pinions on an axle, the number wheels being operatively arranged so that a respective lower value number wheel at an end of a complete revolution rotates an adjacent higher value number wheel further through one numeral part; and an apparatus comprising radially arranged light barrier means for a contactlessly and load-free reading-out of a setting of the number wheels, the light barrier means including several light barriers comprised of several light emitters and one receiver provided for each number wheel.

7. A combination, comprising:

a number barrel mechanism having number wheels, and switching pinions on an axle, the number wheels being operatively arranged so that a respective lower value number wheel at an end of a complete revolution rotates an adjacent higher value number wheel further through one numeral part; and an apparatus comprising radially arranged light barrier means for a contactlessly and load-free reading-out of a setting of the number wheels, the light barrier means being arranged radially on a semi-circle and including one opti-electronic element arranged centrally in each number wheel, a plurality of optical conductors arranged peripherally in a semi-circle and a plurality of opti-electronic elements arranged on a printed circuit.

8. The combination according to claim 7, wherein the apparatus further comprises a multiple prism arranged to surround the one opti-electronic element present centrally in the number wheels so as to focus light and associate it with the peripheral optical conductors.

9. The combination according to claim 7, wherein the peripheral optical conductors are optical signal conductors between a light source and a receiver.

* * * * *